US009315954B2

(12) United States Patent
Morton-Finger

(10) Patent No.: US 9,315,954 B2
(45) Date of Patent: Apr. 19, 2016

(54) ARTIFICIAL TURF

(75) Inventor: Jürgen Morton-Finger, Weinhelm (DE)

(73) Assignee: REIFENHAEUSER GMBH & CO.KG MASCHINENFABRIK, Troisdorf (DE)

( * ) Notice: Subject to any disclaimer, the term of this patent is extended or adjusted under 35 U.S.C. 154(b) by 887 days.

(21) Appl. No.: 12/104,476

(22) Filed: Apr. 17, 2008

(65) Prior Publication Data

US 2008/0260974 A1 Oct. 23, 2008

(51) Int. Cl.

| | |
|---|---|
| ***E01C 13/08*** | (2006.01) |
| ***D01D 5/24*** | (2006.01) |
| ***D01D 5/253*** | (2006.01) |
| ***D01D 5/34*** | (2006.01) |
| ***D01F 8/06*** | (2006.01) |

(52) U.S. Cl.

CPC ..... *E01C 13/08* (2013.01); *D01D 5/24* (2013.01); *D01D 5/253* (2013.01); *D01D 5/34* (2013.01); *D01F 8/06* (2013.01)

(58) Field of Classification Search

CPC .. E01C 13/08; D10B 2505/202; Y10S 273/13
USPC ..... 428/86, 88, 92, 17, 87, 95, 96
See application file for complete search history.

(56) References Cited

U.S. PATENT DOCUMENTS

| | | | | |
|---|---|---|---|---|
| 3,940,522 | A * | 2/1976 | Wessells | 428/17 |
| 4,140,071 | A * | 2/1979 | Gee et al. | 112/475.23 |
| 4,323,612 | A * | 4/1982 | van Issum | 428/89 |
| 5,205,562 | A * | 4/1993 | Hammon | 473/278 |
| 5,601,886 | A * | 2/1997 | Ishikawa et al. | 428/17 |
| 6,491,991 | B2 * | 12/2002 | Seaton | 428/17 |
| 6,753,049 | B2 * | 6/2004 | De Vries | 428/17 |
| 6,955,841 | B2 * | 10/2005 | Weghuis et al. | 428/17 |
| 7,122,245 | B2 * | 10/2006 | Morton-Finger | 428/364 |
| 7,378,148 | B2 * | 5/2008 | Morton-Finger | 428/370 |
| 8,283,003 | B2 * | 10/2012 | Morton-Finger | 428/17 |
| 8,465,813 | B2 * | 6/2013 | Slootweg et al. | 428/17 |
| 2003/0108688 | A1 | 6/2003 | De Vries | 428/17 |
| 2003/0157275 | A1 | 8/2003 | Weghuis | 428/17 |
| 2004/0151870 | A1 * | 8/2004 | Theiss | 428/95 |
| 2004/0170830 | A1 * | 9/2004 | Morton-Finger | 428/373 |
| 2005/0064112 | A1 * | 3/2005 | Nicholls et al. | 428/17 |
| 2006/0057578 | A1 * | 3/2006 | Willner et al. | 435/6 |
| 2006/0216458 | A1 * | 9/2006 | Gilman et al. | 428/87 |
| 2008/0124496 | A1 * | 5/2008 | Avery | 428/17 |
| 2008/0125237 | A1 * | 5/2008 | Avery | 473/278 |
| 2008/0260975 | A1 * | 10/2008 | Morton-Finger | 428/17 |
| 2009/0041956 | A1 * | 2/2009 | Gilman et al. | 428/17 |
| 2009/0252900 | A1 * | 10/2009 | Slootweg et al. | 428/17 |

(Continued)

FOREIGN PATENT DOCUMENTS

| | | | |
|---|---|---|---|
| DE | 3525441 | | 1/1987 |
| KR | 101079047 | B1 * | 11/2011 |

(Continued)

*Primary Examiner* — Cheryl Juska
(74) *Attorney, Agent, or Firm* — Andrew Wilford

(57) ABSTRACT

An artificial turf has a base layer, a multiplicity of blades fixed to and projecting upward from the base layer, and a mass of infill between the blades and on the base layer. The infill is formed of elongated plastic fibers each having a longitudinally extending inner part of a predetermined first plastic and a longitudinally extending outer part bonded to the inner part and of a predetermined second plastic different from the first plastic.

13 Claims, 2 Drawing Sheets

(56) References Cited

U.S. PATENT DOCUMENTS

| | | | | |
|---|---|---|---|---|
| 2010/0021660 | A1* | 1/2010 | Slootweg et al. | 428/17 |
| 2010/0062192 | A1* | 3/2010 | Morton-Finger | 428/17 |
| 2012/0305166 | A1* | 12/2012 | Morton-Finger | 156/61 |

FOREIGN PATENT DOCUMENTS

| | | | |
|---|---|---|---|
| WO | WO 9309294 | A1 * | 5/1993 |
| WO | WO-2006068476 | | 6/2006 |
| WO | WO2012105827 | A1 * | 8/2012 |

* cited by examiner

ARTIFICIAL TURF

FIELD OF THE INVENTION

The present invention relates to artificial turf.

BACKGROUND OF THE INVENTION

Standard artificial turf, especially for sports fields and lawns, has a plurality of blades fixed on a base layer and a mass of infill on the base layer between the blades. In such artificial turf sand or rubber granules charged into the intermediate spaces between the blades as infill. This infill has the long-term disadvantage that it wears down in locations of heavy use and has to be renewed. Furthermore the damping properties of the infill are normally unsatisfactory, leading to so-called "turf toe" and other injuries when used for sports purposes, making artificial turf less popular for many sports, such as soccer.

OBJECTS OF THE INVENTION

It is therefore an object of the present invention to provide an improved artificial turf.

Another object is the provision of such an improved artificial turf that overcomes the above-given disadvantages, in particular whose infill is improved over that of the prior art.

SUMMARY OF THE INVENTION

An artificial turf has according to the invention a base layer, a multiplicity of blades fixed to and projecting upward from the base layer, and a mass of infill between the blades and on the base layer. The infill is formed of elongated plastic fibers each having a longitudinally extending inner part of a predetermined first plastic and a longitudinally extending outer part bonded to the inner part and of a predetermined second plastic different from the first plastic.

The base layer of the artificial turf in accordance with the invention forms as it were an flat generally two dimensional layer preferably formed as a fabric. It is recommended that this textile base layer consists of a plastic and advantageously of a polyolefin, especially polyethylene or polypropylene. It is in the scope of the invention that even the blades of the plastic turf in accordance with the invention are of plastic. According to a preferred embodiment of the invention the blades are formed from plastic fibers or plastic filaments. According to recommended variant monofilaments of thermoplastic plastic form the blades of the artificial turf. The blades of the artificial turf are advantageously fixed on the base layer by tufting.

According to the invention the infill consists of multicomponent fibers applied to the base layer in the intermediate spaces between the blades. The artificial fibers or multicomponent fibers are knotted together. The outer plastic part and the inner plastic part of the multicomponent fibers preferably extend over the entire length or substantially over the entire length of the multicomponent fibers.

It is furthermore in the scope of the invention that a intermediate layer forms another part of the cross-section of the multicomponent fiber and that the intermediate layer in the multicomponent fiber is between the outer plastic part and the inner plastic part. Even the intermediate layer preferably extends over the entire length or substantially over the entire length of the multicomponent fibers. The intermediate layer is advantageously an adhesion promoter between the first and the inner plastic part, that is its outer surface is bonded to the inner surface of the outer layer and its inner surface is bonded to the outer surface of the inner or core layer. According to an especially preferred embodiment of the invention the three plastic parts are the only plastic components of the multicomponent fibers and therefore the multicomponent fibers are three-component fibers.

It is also in the scope of the invention that the multicomponent fibers have a coaxial or core-sheath structure and that the outer plastic part forms the sheath and the inner plastic part forms the core of the multicomponent fibers. The outer plastic part advantageously forms the outer sheath of the multicomponent fibers and surrounds the core at lease partially, preferably for the most part and most preferably completely.

According to a very recommended embodiment of the invention the outer plastic part is a polyolefin, preferably polyethylene and very preferably LLDPE (linear low-density polyethylene). Polyethylene and in particular LLDPE have especially proven themselves in the scope of the invention. Polyolefin, preferably polyethylene and very preferably LLDPE advantageously form the outer part of the multicomponent fibers in the core-sheath structure.

The inner plastic part is preferably a polyamide or a polyester. In particular, polybutylene terephthalate (PBT) can be used as polyester. However, according to a very preferred embodiment of the invention the inner plastic part is a polyamide. It is recommended that the inner plastic part is a polyamide from the group of Nylon 6, Nylon 6.6, Nylon 6.12, or Nylon 6.10. The use of Nylon 6 as the inner plastic part is especially preferred. The inner plastic part advantageously forms the core part of the multicomponent fibers in the core-sheath structure.

It is in the scope of the invention that the intermediate layer in the core-sheath structure of the multicomponent fibers is between the sheath and the core and that the intermediate layer surrounds the core at least partially, preferably completely or substantially completely. The intermediate layer forms as it were an intermediate tube of the core-sheath structure whereas the outer plastic part preferably forms an outer tube. It is furthermore in the scope of the invention that the intermediate layer is a plastic that acts as an adhesion promoter between the first and the inner plastic part. Plastics that can act as adhesion promoter, especially between a polyolefin and a polyamide, are basically known in the art. According to a recommended variant of the invention the intermediate layer is a polyamide/polyolefin copolymer, preferably a polyamide/polyethylene copolymer. According to another preferred variant a polyolefin modified with a maleic acid derivative, preferably with maleic acid anhydride, is used as the intermediate layer. The modified polyolefin is preferably modified polyethylene or polypropylene.

The multicomponent fibers preferably comprise 5 to 50%, preferably 10 to 45%, and very preferably 10 to 40% of the outer plastic part as regards their cross-sectional area. The previous and subsequent data refer to the percentage of the cross-sectional area that the particular part occupies as concerns the overall cross-sectional area of a multicomponent fiber. It is recommended that the multicomponent fibers comprise 3 to 20%, preferably 5 to 20%, and most preferably 5 to 15% of the intermediate layer as regards their cross-sectional area. According to a preferred embodiment of the invention the multicomponent fibers comprise 30 to 93%, preferably 30 to 85% and most preferably 35 to 80% of the inner plastic part as regards their cross-sectional area. As describe above, the outer plastic part forms the sheath or outer sheath of the multicomponent fiber and the inner plastic part forms the core of the multicomponent fiber in the coaxial or core-sheath structure. The intermediate layer is preferably arranged between the outer plastic part (sheath or outer tube) and the inner plastic part (core) and advantageously acts as adhesion promoter between the first and the inner plastic part. According to a very preferred embodiment of the invention the inner plastic part or the core part is the main constituent of the multicomponent fibers. The inner plastic part advantageously occupies more than 40%, preferably more than 45% of the cross-sectional area of the respective multicomponent fiber.

A quite especially preferred embodiment of the invention is characterized in that the multicomponent fibers are made into a textured yarn and the yarn is used as the infill on the base layer between the blades. It is in the scope of the invention that the multicomponent fibers are textured in a texturing machine. The textured fibers are permanently curled multicomponent fibers that are quite especially suited as infill for the artificial turf.

Furthermore according to the invention the multicomponent fibers in accordance with the invention are spun from a spinning nozzle or spinneret. The individual plastic parts are supplied to the spinning nozzle in a customary manner from extruders. After spinning, the multicomponent fibers are cooled, preferably in a water bath. The multicomponent fibers can subsequently be stretched. The conversion of the fibers to textured yarn takes place according to a preferred embodiment.

According to an especially recommended embodiment of the invention even the blades of the artificial turf are formed from multicomponent fibers or multicomponent elements that are preferably formed in a coaxial or core-sheath structure. An outer plastic part forms a part of the cross section of a blade and extends at least substantially over the length of the blade. A inner plastic part forms another part of the cross section of a blade and also extends at least substantially over the length of the blade. The outer plastic part preferably forms a tube surrounding the inner plastic part as core of the multicomponent fiber in such a core-sheath structure. An intermediate layer is also advantageously provided here that forms a part of the cross section of a blade and extends at least substantially over the length of the blade. It is recommended that the intermediate layer in the multicomponent fiber is arranged between the outer plastic part and the inner plastic part, preferably between the sheath (outer plastic part or tube) and the core (inner plastic part) of the multicomponent fiber in the core-sheath structure. The intermediate layer preferably acts as adhesion promoter between the first and the inner plastic part. According to the invention the features and embodiments cited above regarding the outer plastic part, the inner plastic part and the intermediate layer in conjunction with the infill also apply to their full extent to the plastic parts of the blades and to the blades. Thus, the multicomponent fibers for the blades also preferably have a sheath part of polyolefin, preferably of polyethylene and very preferably of LLDPE. Furthermore, it is recommended that the multicomponent fibers for the blades have a core of polyamide, preferably of Nylon 6. The intermediate layer is preferably arranged as it were as an intermediate tube in these multicomponent fibers for the blades and surrounds the core at least partially, preferably completely.

The invention is based on the recognition that the infill in accordance with the invention in the form of multicomponent fibers meets all requirements and has excellent damping properties. The disadvantageous loss of material that occurs at least in the long term and at least in areas in the case of the known infills practically does not take place at all with the infill in accordance with the invention but rather the infill in accordance with the invention remains permanently in place even after considerable and prolonged mechanical stress. Furthermore, it should be emphasized that the infill in accordance with the invention is distinguished by excellent compatibility with the skin. If players fall and slide on the artificial turf, this does not result in any appreciable injuries to or burns on the skin. The design of the multicomponent filaments in core-sheath structure effectively contributes to this. The artificial turf in accordance with the invention is also excellently suited for lawns, pool surrounds, and the like.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
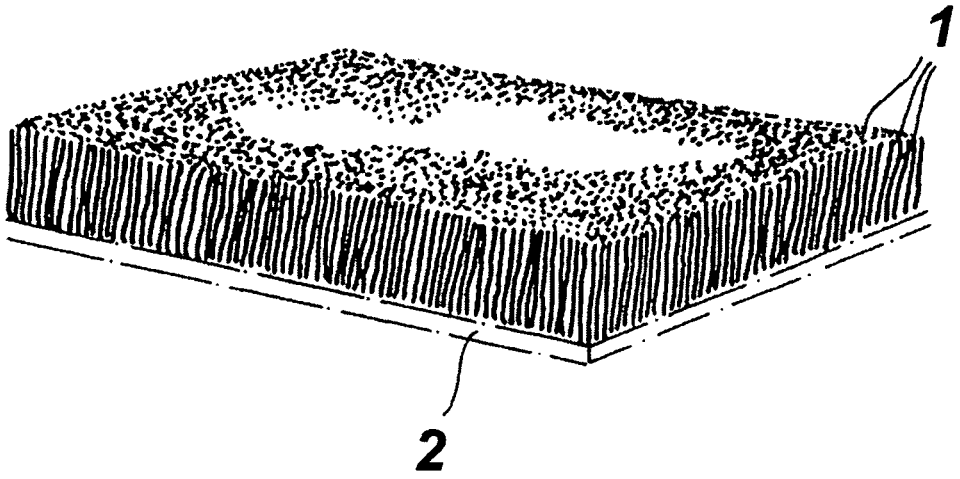
FIG. 1 is a perspective view of a piece of artificial turf according to the invention.

As seen in FIG. 1, artificial turf in accordance with the invention consists of a plurality of blades 1 fixed on a base layer 2. The blades 1 are formed by multicomponent monofilament fibers and are advantageously fixed on the base layer 2 by tufting.

Figure 2:
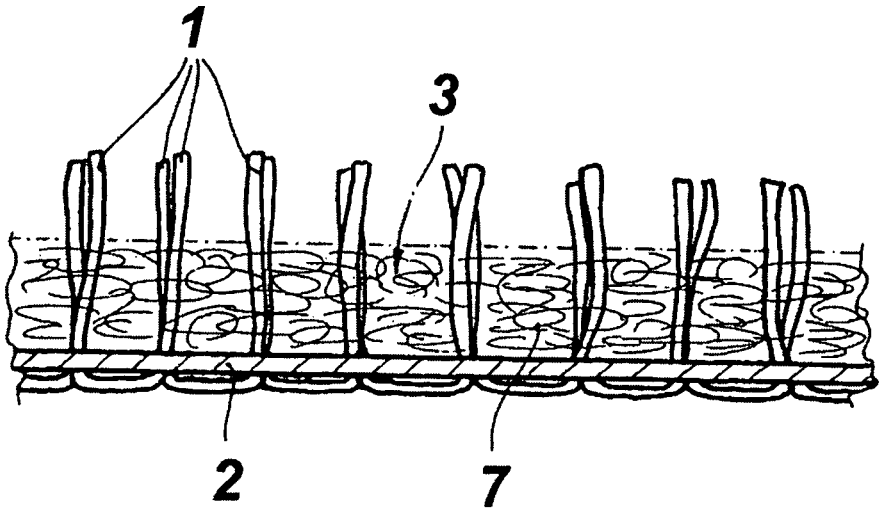
FIG. 2 is a large-scale vertical section through the inventive artificial turf.

FIG. 2 shows the artificial turf in greater detail. Here, the blades 1 are shown projecting through the base layer 2 and joined together underneath it, with their free ends projecting upward from it. The base layer 2 is in particular a woven, knitted, or felted fabric or plastic textile consisting preferably of a polyolefin, preferably polypropylene or polyethylene. A layer 3 of infill in accordance with the invention is formed of multicomponent fibers 7 situated between the blades 1 on the base layer 2. The multicomponent fibers 7 are preferably sections of textured yarn.

Figure 3:
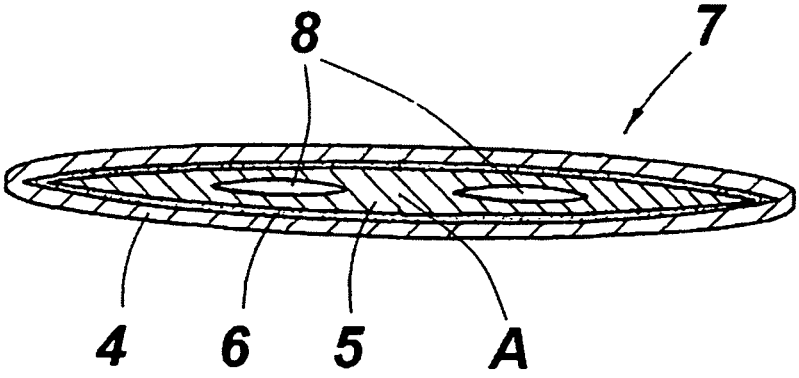
FIG. 3 is a cross-section through a multicomponent fiber used as infill in the inventive artificial turf.

FIG. 3 shows a cross section through a single multicomponent fiber 7 in accordance with the invention for the infill 3, a longitudinal axis A of the fiber 7 being perpendicular to the plane of view of FIG. 3. The multicomponent fibers 7 are constructed here in a core-sheath structure. More particularly, an outer tube or sheath 4 preferably consists here and in the illustrated embodiment of polyethylene, preferably of LLDPE (linear low-density polyethylene). Its core 5 preferably consists here and in the illustrated embodiment of polyamide, very preferably of Nylon 6. An intermediate layer is provided between the sheath 4 and the core 5, which intermediate layer consists of a copolymer of polyamide and polyethylene or of polyethylene or polypropylene modified with maleic acid anhydride. The intermediate layer forms an inner tube or sheath 6 that completely surrounds core 5 and acts as adhesion promoter between the sheath 4 and the core 5. Thus the sheath 4 forms a flattened tube whose inner surface is bonded to the outer surface of the intermediate layer 6 that is also formed as a flattened tube and whose inner surface is bonded to the outer surface of the core 5 that itself is formed as a flattened body having two arcuate and outwardly convex outer surfaces meeting at sharp edges, with as illustrated a plurality of longitudinally extending cushion voids 8. The core 5 and the outer layer 4 preferably form the main constituent of the multicomponent fiber here and in the illustrated embodiment.

I claim:

1. An artificial turf comprising:

a base layer;

a multiplicity of blades fixed to and projecting upward from the base layer; and a mass of infill between the blades, on the base layer, and formed of longitudinally elongated plastic fibers knotted with each other and each having a longitudinally extending inner part of a predetermined first plastic and a longitudinally extending outer part bonded to the inner part and of a predetermined second plastic different from the first plastic.

2. The artificial turf defined in claim 1 wherein the outer part is tubular and surrounds the inner part.

3. The artificial turf defined in claim 2 wherein the outer part is a polyolefin.

4. The artificial turf defined in claim 3 wherein the outer part is polyethylene.

5. The artificial turf defined in claim 4 wherein the outer part is linear low-density polyethylene.

6. The artificial turf defined in claim 2 wherein the inner part is polyamide or polyester.

7. The artificial turf defined in claim 6 wherein the inner part is Nylon 6, Nylon 6.6, Nylon 6.1, or Nylon 6.10.

8. The artificial turf defined in claim 2 wherein each fiber further comprises a tubular intermediate part surrounding the inner part, surrounded by the outer part, and of a third plastic different from at least one of the first and second plastics.

9. The artificial turf defined in claim 8 wherein the inner part, the intermediate part, and the outer part all extend generally full lengths of the fibers.

10. The artificial turf defined in claim 8 wherein the intermediate part is formed of a polyamide/polyolefin copolymer or a polyolefin modified with maleic acid derivative.

11. The artificial turf defined in claim 1 wherein the elongated plastic fibers form a textured yarn forming the infill on the base layer between the blades.

12. The artificial turf defined in claim 1 wherein the inner part has a cross-sectional area equal to between 5% and 50% of a cross-sectional area of the respective fiber.

13. The artificial turf defined in claim 1 wherein the elongated plastic fibers are of flattened cross-sectional shape.

* * * * *